US005873666A

United States Patent [19]

Bourke et al.

[11] Patent Number: 5,873,666

[45] Date of Patent: Feb. 23, 1999

[54] WAX APPLICATOR

[76] Inventors: Jane Vanessa Bourke, 182 Fitzherbert Avenue; Christine Ruth Hudson, 6 Wairau Place; Francis Patrick O'Hare, 111 Slacks Road, all of Palmerston North 5301; Michael Glen Robins, RD 7, Walkers Road, Palmerston North 5321, all of New Zealand

[21] Appl. No.: 602,746

[22] PCT Filed: Jun. 22, 1995

[86] PCT No.: PCT/NZ95/00057

§ 371 Date: Feb. 23, 1996

§ 102(e) Date: Feb. 23, 1996

[87] PCT Pub. No.: WO96/00021

PCT Pub. Date: Jan. 4, 1996

[30] Foreign Application Priority Data

Jun. 23, 1994 [NZ] New Zealand ..... 260833

[51] Int. Cl.[6] ..... A45D 40/00; A45D 26/00

[52] U.S. Cl. ..... 401/1; 401/2; 401/5; 401/263; 401/266

[58] Field of Search ..... 401/1, 2, 5, 263, 401/266; 222/561

[56] References Cited

U.S. PATENT DOCUMENTS

| | | | |
|---|---|---|---|
| 364,649 | 6/1887 | Holden | 401/266 X |
| 1,797,686 | 3/1931 | Homer | 401/263 X |
| 2,320,485 | 6/1943 | Straub | 222/561 |
| 2,376,243 | 5/1945 | Fraser | 401/5 X |
| 2,701,078 | 2/1955 | Bowman | 222/561 X |
| 3,088,470 | 5/1963 | Hall | 401/261 X |
| 3,334,792 | 8/1967 | De Uries et al. | 401/5 |
| 3,659,758 | 5/1972 | Waterman | 222/561 |
| 3,858,985 | 1/1975 | Fiveash | 401/2 |
| 4,958,951 | 9/1990 | Mann | 401/1 |
| 5,078,527 | 1/1992 | Bell | 401/263 X |

FOREIGN PATENT DOCUMENTS

| | | | |
|---|---|---|---|
| 106426 | 5/1927 | Austria | 401/263 |
| 0 249 911 | 12/1987 | European Pat. Off. . | |
| 0 273 495 | 7/1988 | European Pat. Off. . | |
| 0 499 317 | 8/1992 | European Pat. Off. . | |
| 825874 | 3/1938 | France | 222/561 |
| 1178257 | 5/1959 | France | 222/561 |
| 2467786 | 5/1981 | France | 401/1 |
| 589917 | 3/1959 | Italy | 222/561 |

*Primary Examiner*—Steven A. Bratlie
*Attorney, Agent, or Firm*—Young & Thompson

[57] ABSTRACT

A wax applicator for use in a depilatory waxing procedure. The wax applicator has a body portion (10) with a mounting part (11) for the mounting of the body portion to a wax container (T). A flow passage (13) leads from the mounting part (11) to a narrow elongate outlet (14). Wax can flow from the container (T) along the flow passage (13) to the outlet (14). A spreader (15) is associated with the outlet (14). The spreader (15) has a distal edge located beyond the outlet so that in use wax issuing form the outlet (14) can spill over the distal edge of the spreader (15) as the applicator is moved forwardly in the direction in which the spreader (15) projects beyond the outlet (14).

23 Claims, 5 Drawing Sheets

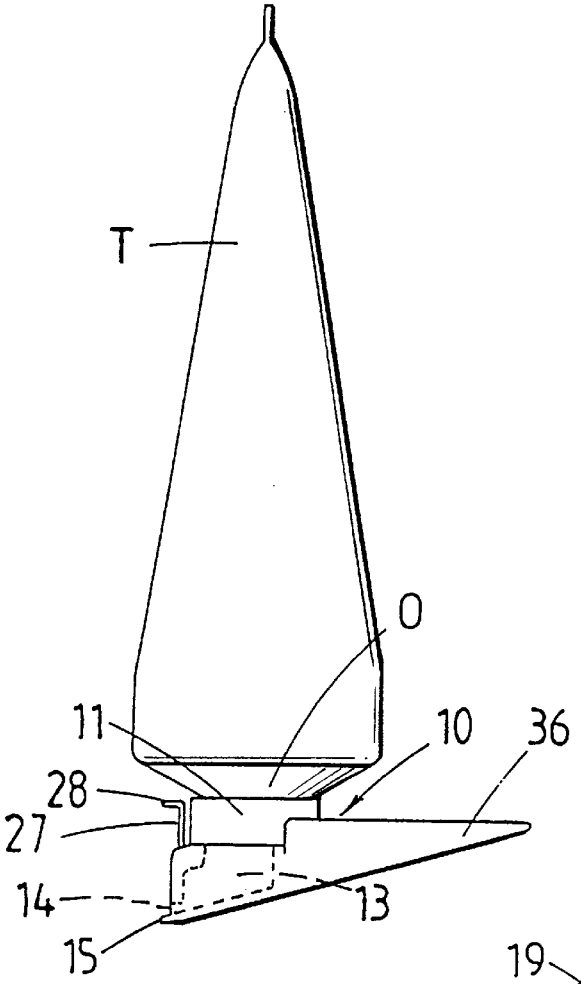
FIG. 1
FIG. 2
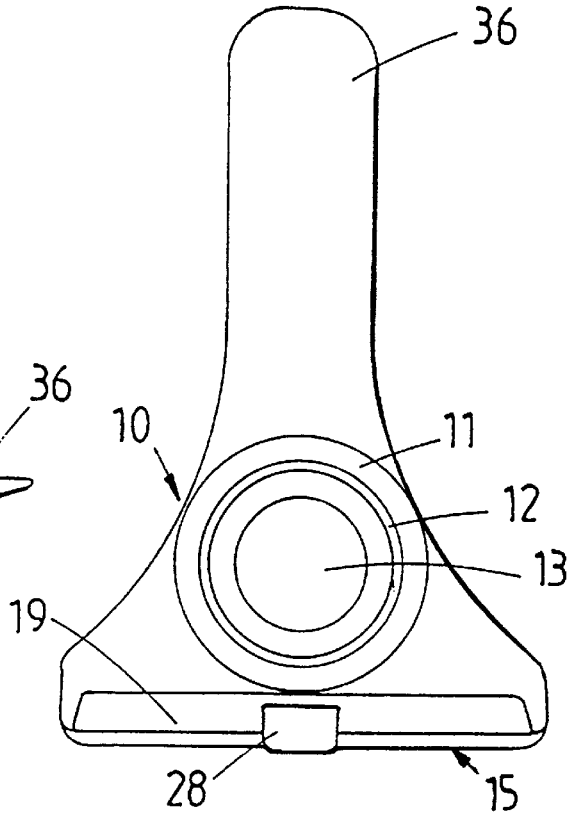
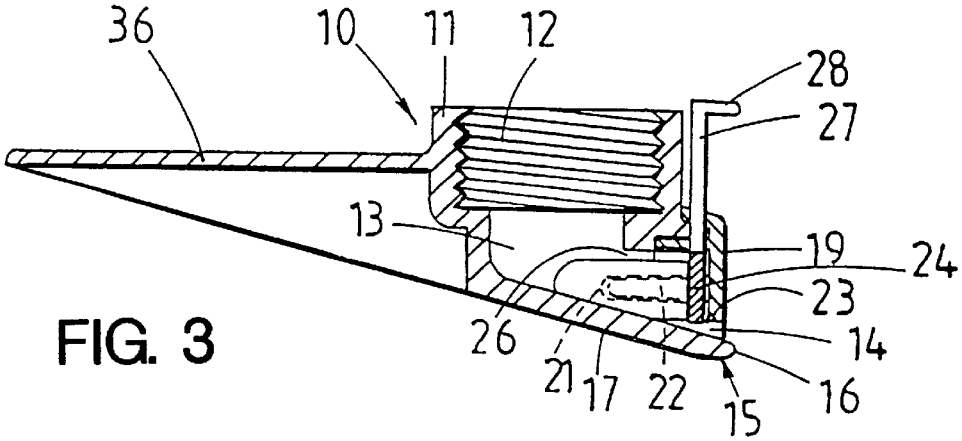
FIG. 3

WAX APPLICATOR

FIELD OF THE INVENTION

This invention relates to a wax applicator and, more particularly an applicator for use in a depilatory waxing procedure.

BACKGROUND OF THE INVENTION

At present a wax depilating procedure typically involves the application of wax to the surface of the skin with a spatula or like tool. Generally the spatula will be re-used after cleaning. Also it is common for depilating procedures for a number of people to be carried out by using wax from a single container.

As a consequence there is a possibility that current procedures may result in cross-infection of viruses including Hepatitis B and HIV. Such cross-infection can arise, for example, from the use of a partially cleaned spatula and/or by using infected wax as a consequence of using wax for different clients from a common source.

SUMMARY OF THE INVENTION

The object of the present invention is therefore to provide a wax applicator designed to minimize spread of infectious diseases which could be caused by the re-use of spatulas or like applicating tools and/or contaminated/infected wax.

Broadly the present invention in one aspect consists of a wax applicator comprising a body portion having a mounting part via which the body portion can be mounted with a wax container, a flow passage leading from the mounting part and through which wax from the container can flow to an outlet, there being spreader means associated with the outlet whereby wax issuing from the outlet can be applied to a surface.

The mounting part can in one form of the invention be formed by a threaded bore which can mate with the threaded outlet of the container. Preferably the container is a flexible tube within which the wax is contained.

According to one embodiment of the invention the outlet is of thin elongate shape and is in part formed by the spreader means. In this form of the invention the spreader means can be the terminal edge of a wall part of the body portion. In one form the wall can be formed of metal or plastic material and is attached to the body portion which is otherwise of unit construction from the plastic material.

BRIEF DESCRIPTION OF THE DRAWINGS

In the following more detailed description of a preferred form of the invention reference will be made to the accompanying drawings in which:

FIG. 1 is a side elevation view of the wax applicator embodying the invention, the applicator being shown close to actual size and mounted on a flexible tube containing wax, FIG. 2 is a top plan view in enlarged scale of the applicator shown in FIG. 1, FIG. 3 is a sectioned side elevation view of the applicator shown in FIG. 2.

DESCRIPTION OF THE PREFERRED EMBODIMENTS

Figure 4:
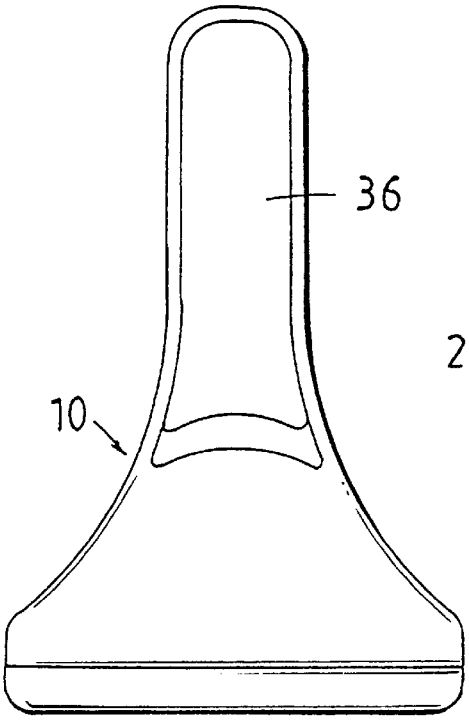
FIG. 4 is an underside plan view of the applicator of FIGS. 2 and 3.
Figure 5:
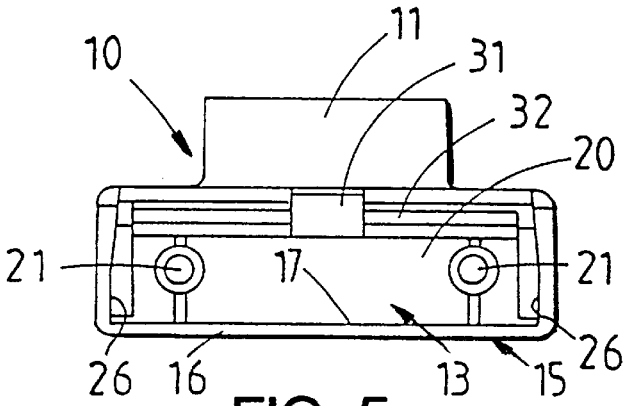
FIG. 5 is a front elevation view of the applicator of FIGS. 2 to 4 with the end plate and closure slide removed.
Figure 6:
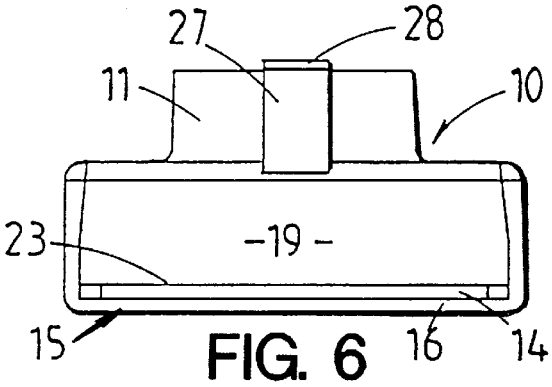
FIG. 6 is a front elevation view of the applicator as shown in FIGS. 1–4.
Figure 7:
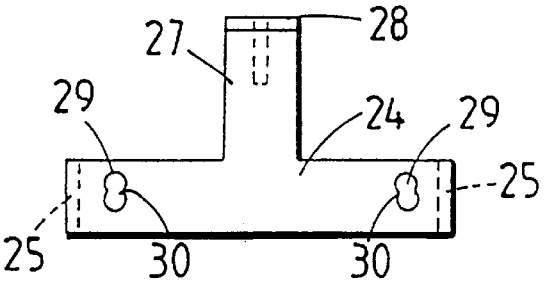
FIG. 7 is an elevation view of the closure slide of the applicator.
Figure 8:
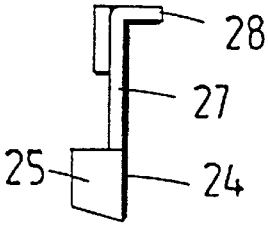
FIG. 8 is an end elevation view of the closure slide of FIG. 7.

The applicator according to the present invention can take many forms and the following is an example of one preferred form. According to this form of the invention the applicator consists of a body portion 10 which can be entirely molded from a suitable plastic material or be constructed principally in one piece from plastic material but with the spreader (as hereinafter described) formed from a metal such as stainless steel.

In the preferred and illustrated form of the invention the applicator is designed to fit to the outlet end O of a tube T (see FIG. 1). To this end body 10 incorporates a mounting portion 11 having a threaded bore 12. Body 10 can thus be threaded onto the outlet end O of tube T such that wax from the tube T can pass (generally by applying a slight squeezing pressure to the tube T) along a flow passage 13 to an outlet 14.

In the illustrated arrangement of FIG. 1 the tube T is sized to nominally hold 75 gm of wax. Preferably the outlet opening of the tube is as large as possible (e.g., 8 mm in the illustrated arrangement) such that there is good flow of wax from the tube into the applicator and total (as far as practicable) dispensing of wax from the tube is achieved to prevent wastage.

As illustrated in FIG. 3 flow passage 13 is preferably configured so that it flares or tapers outwardly toward a long narrow elongate outlet 14. This outlet 14 preferably extends for all or substantially all of the length of the spreader 15.

The flow passage 13 is preferably configured such that wax moving there-through does not flow too fast resulting in uncontrolled dispensing of the wax through the outlet 14. Also flow passage 13 is such that the wax which contacts the sides of the flow passage and which tends to cool and solidify does not restrict the flow of wax through the flow passage to outlet 14. While there is a possibility of a skin on the wax forming at the outlet 14, this can simply be broken by applying pressure to the tube T which in turn forces the wax along the flow passage 13.

Preferably the applicator is pre-warmed (as described later) prior to use so as to keep any solidifying of the wax at the interface with the walls of the flow passage to a minimum.

The spreader 15 is formed in the preferred form illustrated, by the terminal end 16 of wall 17. This wall 17 defines part (e.g., floor) of the flow passage 13 as well as one side of outlet 14. Wall 17 can be a removable element (made, for example, of a suitable metal) though in the more preferred form of the invention as illustrated it is molded as part of the body 10. If required the terminal edge 16 of wall 17 can be profiled (e.g., rounded) to suit the end purpose of spreading wax issuing from outlet 14 to the surface of skin to which wax is to be applied for the removal of hair. Preferably it is formed as thin in cross-section as possible.

In the arrangement shown the applicator is formed in one piece except that for molding purposes, the forward end of the applicator is formed by a removable end plate 19. To this end there is formed inward of the open end 20 of the body 10, a pair of openings 21 into which spigots 22 of the end plate 19 are forced. These elements combine to keep the end plate 19 in position so as to close off the open end 20. The lower edge 23 of the end plate 19 however, is located above and spaced from the spreader 15 so as to form the outlet 14.

In the preferred form of the invention as illustrated the applicator further includes a closure slide 24 whereby the elongate outlet 14 can be closed. However, in a less preferred embodiment this closure slide can be omitted such that the flow passage 13 simply opens direct into the outlet 14.

The closure slide 24 is an elongate plate which has a return portion 25 at each end. This return portion 25 locates against the inner surface 26 of the side walls of the flow passage 13.

Extending upwardly from a mid-point of the plate 24 is a projection 27, this having a tab or return 28 at its distal end. The plate 24 further includes an elongate opening 29 adjacent each end, each opening being slightly waisted as at 30.

A recess 31 is formed in wall 32 which defines the upper portion of the open end 20 of body 10. The projection 27 slidingly engages in recess 31.

A correspondingly positioned recess 33 is formed in a return 34 at the top edge of end plate 19. A recess 33' is also formed in flange 35, the recess being located and spaced below return 34.

To assemble the applicator the projection 27 is located in recess 30 with the result that the slider plate 24 sits against the ends of the openings 21 with end returns 25 located against inner surfaces 26 of the side wall of the applicator 10. The openings 29 in the slider plate 24 coincide with the openings 21. The end plate 19 is then placed in position with the result that the spigots 22 pass through openings 29 and into openings 21 while return 34 and flange 35 locate over and under the wall 32 such that the projection 27 also locates within recesses 33 and 33'.

The slider plate 24 can be moved between two definite positions, one which closes the outlet 14 and the other which leaves the outlet unrestricted. These two positions are achieved by the slight waisting 30 of the elongate openings 29, the waisting providing a restriction which is the same or slightly less than the diameter of the spigots 22. Accordingly, a positive pressure must be applied to tab 28 to move the slider plate between the respective open and closed positions.

In its simplest form applicator body 10 is simply screwed to outlet end O of the tube T and the operator, using tube T as a handle, simply squeezes wax so that it flows through the flow passage 13. The wax thus issues through outlet 14 and a build up of wax can occur on the wall surface of end plate 19 above the spreader 15. Following this "loading" of the end plate/spreader the spreader is moved over the skin in much the same way as a spatula (as typically used with known depilating procedures). The wax flows over the edge of spreader 15 so as to become applied to the skin.

When the application of wax to the person concerned has been completed the applicator body 10 is then removed from the tube T and disposed of. As a consequence the likelihood of cross-infection by the re-use of a spatula is minimized or indeed avoided. Furthermore as a quantity of wax remains in the applicator 10 the likelihood of contamination of the remaining wax in the tube T when the tube is re-fitted to a fresh applicator for use on a further client is significantly reduced. This reduction may even be to the point where there is no likelihood of any contamination.

Figure 11:
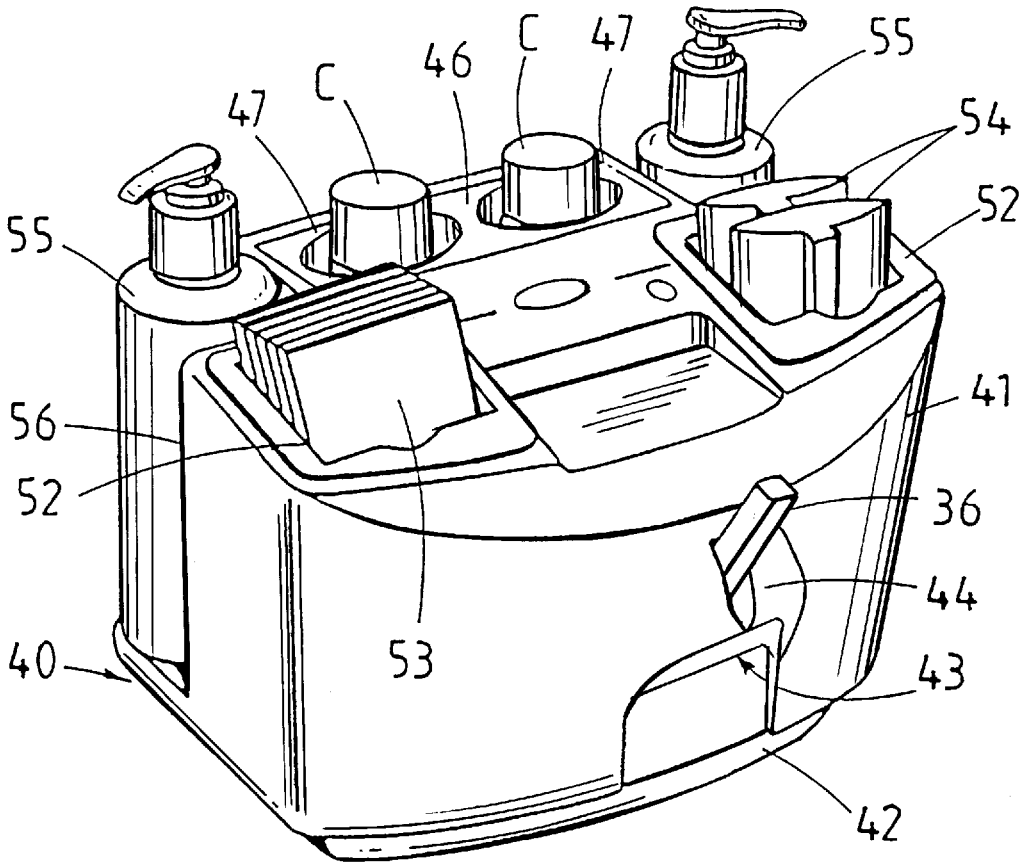
FIG. 11 is a perspective view of a heater unit.
Figure 12:
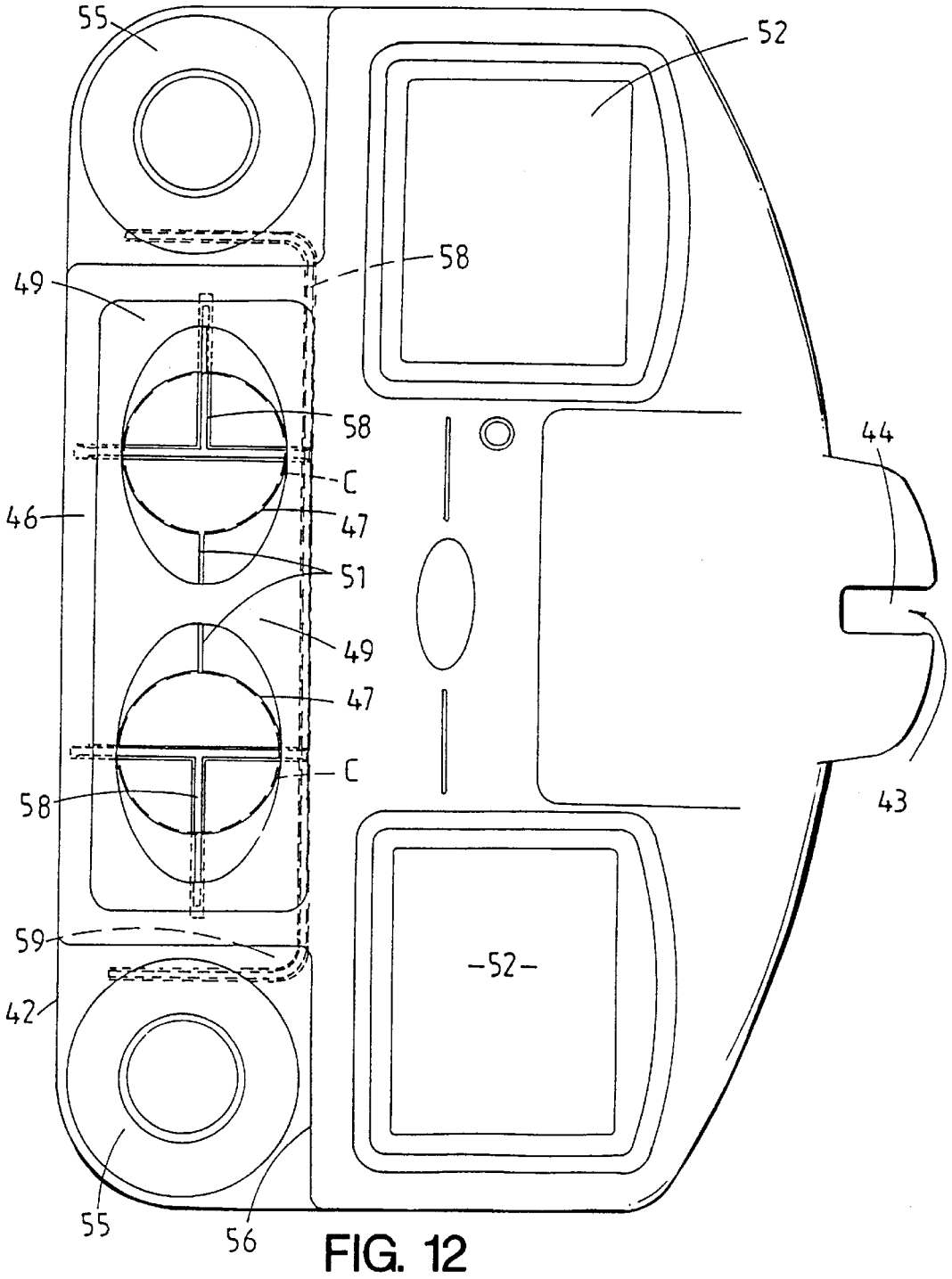
FIG. 12 is a top plan view of the heater unit.

While the applicator according to the invention meets the objective of minimizing the spread of infectious diseases other advantages arise from the nature of having a disposable applicator combinable with a tube containing wax. For example, a simple yet effective heating unit can be used in conjunction with the tubes of wax and the applicator and such an arrangement is illustrated in FIG. 11.

The heater unit 40 is formed by a housing 41 (preferably of molded plastic construction) which locates on a base 42 (also of molded plastic construction). In the front of the housing 41 there is an opening 43 into which a tube T with an applicator 10 attached can be inserted. A projecting piece 36 of applicator 10 engages in an interference or friction fit in a slot 44 as shown.

Extending inwardly from opening 43 is a heating chamber 45 which in the preferred form of the invention is formed from aluminum sheet and is shaped to conform with the general shape of tube T. Engaged about the exterior of tubular chamber 45 is a heating wire (not shown) whereby the chamber 45 can be heated and thus a tube T when located within the chamber can be heated.

In a top wall portion 46 of housing 41 is at least one but preferably two openings 47 through which further tubes T (with caps C in place) can be inserted. A tubular heating chamber 48 is associated with each opening 47 and into which a tube T is insertable. As with chamber 45 heating wires are engaged about chambers 48 so that tubes T can be heated when located within the chambers 48.

Figure 13:
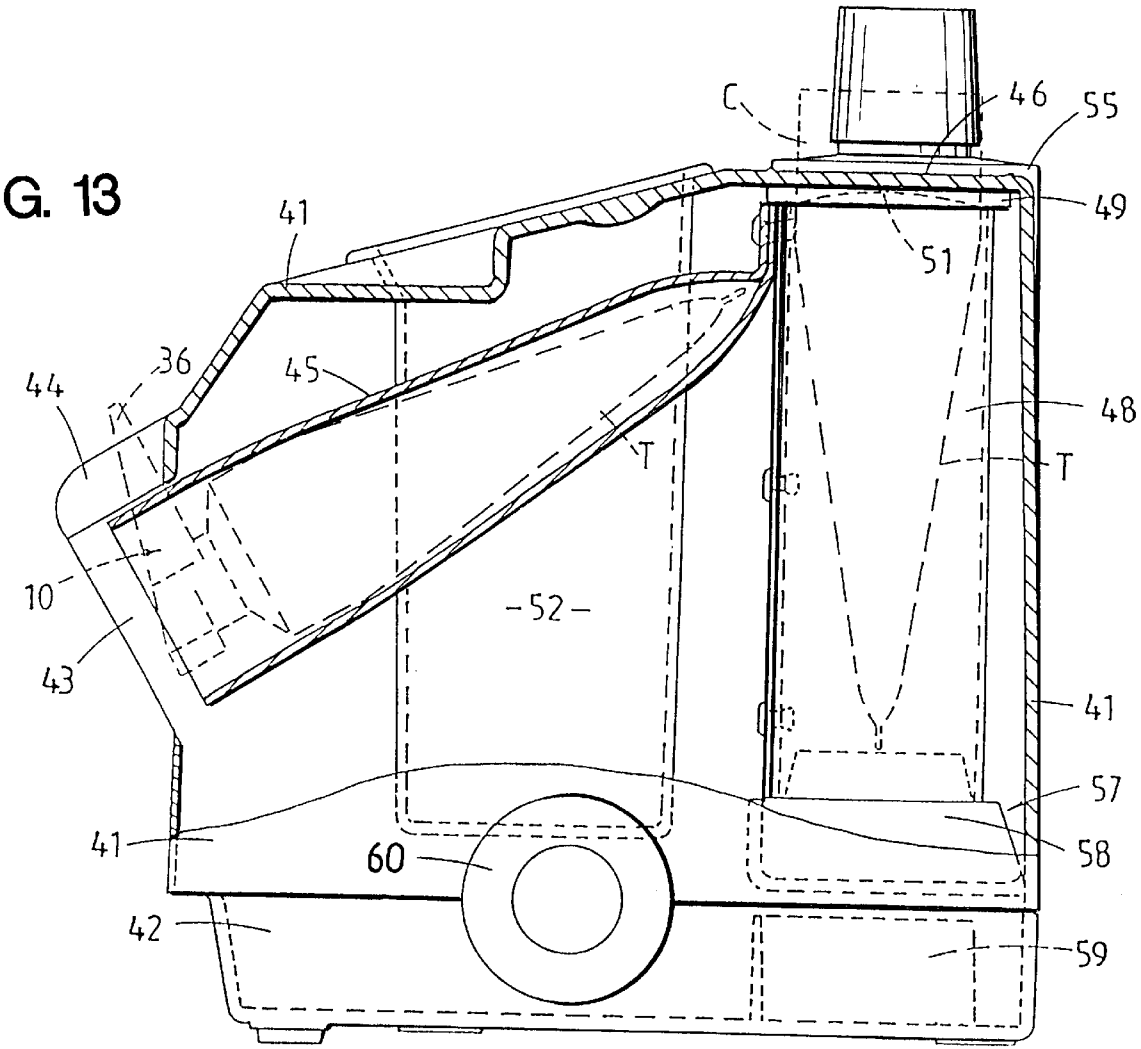
FIG. 13 is a partially sectioned end elevation of the heater unit.

In the preferred form of the invention a flexible seal 49 is located between opening 47 and the entrance to chamber 48. This flexible seal has an opening 50 with diametrically opposed slits 51 to enable the tube T to be forced therethrough yet seal around the neck or cap of the tube so as to retain as much heat as possible within the heating chamber 48 (see FIG. 13).

Pockets 52 are formed in housing 41. These provide locations respectively for strips of pellon 53 and containers 54 in which applicators 10 are hygienically sealed.

As shown, dispensers 55 for pre- and post- locations can be provided in suitably shaped recesses 56 in the housing 41.

Electronic control means is provided for controlling the heating of chambers 45 and 48 respectively. This control is a thermostatic control with manual setting being achievable via a control knob 60. The circuitry and a thermostatic control is in accordance with known electronic control techniques and is therefore well known to people skilled in the art. The circuitry, however, is such that the thermostatically controlled temperature of the heating chamber 45 is preferably held at 10° C. higher than chambers 48. Furthermore, the control circuitry includes a thermal cut-off in the event that any of the heating chambers heats to greater than a pre-determined temperature, e.g., 100° C.

Heat emanating from the heating chambers 45 and 48 also result in slight heating of the interior of the housing 41 and thereby the pockets 52. This results in the applicators in containers 54 being pre-warmed so that when a new applicator is mounted to a pre-heated tube T in a chamber 48 easy flow of wax through the flow passage 13 can take place.

In use the wax in tube T located in chamber 45 is heated to maintain the wax at the required working temperature.

Figure 9:
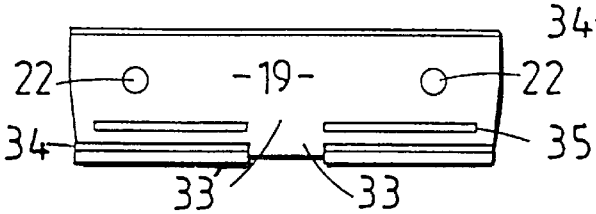
FIG. 9 is an elevation view of the inside face of the end plate fitted to the applicator shown in FIGS. 2 to 6.
Figure 10:
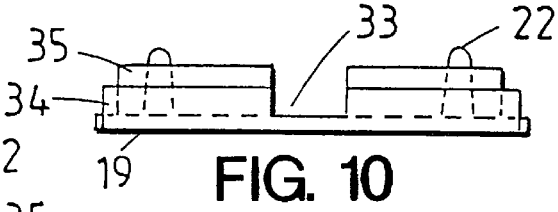
FIG. 10 is a top plan view of the end plate shown in FIG. 9.

Preferably the tube T is located in a downwardly inclined orientation as shown in FIG. 9. The tube T with attached applicator 10 can, when required, be removed from the heating chamber and wax applied to the client. The tube with applicator can then be simply re-inserted in opening 43 during the depilating procedure to either re-heat the wax or simply maintain the wax at the required temperature while the actual hair removing procedure is being carried out. A closure (not shown) can be provided so as to close off opening 43 when the tube T has been removed so as to ensure that heat within the chamber is not lost.

A typical depilating procedure using the applicator according to the present invention is as follows.

A tube T (with a conventional cap or lid C in place) after having reached the application temperature is taken from one of chambers 48 of the heater unit. After removal of the cap C the applicator 10 is installed on the tube. The tube T and applicator is then placed into the "in use" heating chamber 45 ready for use.

The tube and applicator can then be removed from chamber 45 to enable wax to be applied to the skin. Firstly, the slider plate 24 of the applicator is moved to the open position i.e., outlet 14 is opened. The tube T is then squeezed very gently until a small amount of wax appears on the front of the applicator, i.e., there is a small build up of wax on the external face of the front plate 19 and the spreader 15 as described previously. The applicator is then held at an angle of approximately 45° to the leg and simply moved down the leg without applying pressure to the tube or squeezing the applicator too firmly onto the skin. Wax simply issues over the edge of the spreader 15 and under the applicator to form a strip of wax along the leg equal to substantially the width of the spreader 15. The user can simply observe the front of the applicator to ensure that the slight build up or "loading" of wax remains on plate 19/spreader 15 which ensures the correct spread of wax over the lip of the spreader 15.

Once the leg or part of the leg has been covered with wax the slider plate 24 is moved back to the closed position by pressing down on the tab 28. The applicator 10 is placed back into the "in use" opening 43. Wax is then removed from the skin with a pellon strip 53 taken from pocket 52, the strip being used in the traditional fashion. These procedures are then repeated until the waxing procedure has been completed.

Having completed the depilating procedure the applicator 10 is removed from tube T whereupon the cap C is returned to the tube. The tube is then returned to the rear storage opening 47 from which it was originally taken so as to maintain the remaining wax in the tube at a "working" temperature ready for next use. The applicator 10 removed from the tube T is disposed of.

A support 57 is provided at the lower end of each heating chamber 48 and on which the lower end of the tube T can engage. In the illustrated form the support is in the form of a pair of partitions 58 so that any wax which may spill from the tube T can pass down into a well 59 formed in the base of the heater unit. An opening (not shown) in the floor of the base enables any wax accumulating in the well 59 to drain from the base thereby ensuring the wax does not overflow and into other working componentry (e.g., the electric components) of the heater unit.

The present invention thus provides an effective and efficient means of providing for application of wax during a depilating procedure but with minimal chance of cross-infection caused by the re-use of partially clean spatulas and/or using infected wax. It is also believed that the present invention provides for a cleaner procedure with reduced wastage and mess. Furthermore, burning of a client which is a risk with conventional spatulas is avoided.

We claim:

1. A wax applicator, comprising:

a body portion;

a mounting part integral to said body portion for mounting said body portion onto a wax container, said mounting part having an opening axis extending in a first direction so that the wax container extends in the first direction from said body portion when the wax container is mounted on the mounting part;

a passage through said body portion that extends from said mounting part to a generally elongate outlet for wax that opens toward a second direction at a first angle to said first direction;

an elongate closure plate for selectively closing said outlet;

a wax spreader surface integral to said body portion and extending along a width of said body portion parallel to an edge of said closure plate, said closure plate being slideably engaged to said body portion at a non-zero angle with said wax spreader surface, said edge of said closure plate and said wax spreader surface defining a periphery of said outlet, said wax spreader surface having a lip extending in a third direction beyond the periphery of said outlet and at a second angle to said first direction, said second angle being greater than perpen dicular.

2. A wax applicator as claimed in claim 1, wherein said passage extends in increasing cross-sectional area from said mounting part to said wax spreader surface and closure plate defined outlet.

3. A wax applicator as claimed in claim 1, wherein the mounting part has a threaded bore mateable with a threaded neck of the container.

4. A wax applicator as claimed in claim 1, wherein said body portion includes a first wall, an edge of said first wall defining a part of the outlet.

5. A wax applicator as claimed in claim 4, wherein said body portion includes a second wall integral to said wax spreader surface, an opposite part of the outlet being defined by said second wall.

6. A wax applicator as claimed in claim 4, wherein said closure plate has an operating element, said first wall mounting said slidable closure plate, which is selectively moveable between first and second positions to open and to close the outlet, said operating element extending from the closure plate externally from the body portion.

7. A wax applicator as claimed in claim 6, wherein said body portion includes molded plastic construction and said first wall is a separate component mounted to said body portion by engagement of spigots in sockets, said spigots engaging said sockets through elongate openings in the closure plate, said elongate openings being waisted to prevent free movement of the closure plate by the spigots moving from one end of the elongate openings to the other end except by application of a force via the operating element.

8. A wax applicator as claimed in claim 1, wherein said closure plate is selectively movable between first and second positions to open and to close the outlet.

9. A wax applicator as claimed in claim 1, wherein said body portion includes a handle projecting in an opposite direction to that in which the lip extends beyond the outlet.

10. A wax applicator, comprising:

a wax container having a nozzle end;

a body portion;

a mounting part integral to said body portion for mounting said body portion onto said nozzle end so that said wax container extends from said body portion in a first direction;

a passage through said body portion that extends from said mounting part to an elongate outlet for wax that opens toward a second direction at a first angle to said first direction;

an elongate closure plate for selectively closing said outlet;

a spreader integral to said body portion and extending along a width of said body portion parallel to an edge of said closure plate, said closure plate being slideably engaged to said body portion at a non-zero angle with a surface of said spreader, said edge of said closure plate and said surface of said spreader defining said outlet, said spreader having a single lip extending in a third direction beyond the closure plate and the spreader surface defined outlet and at a second angle to said first direction, said second angle being greater than perpendicular.

11. A wax applicator as claimed in claim 10, wherein the container is a flexible walled tube.

12. A wax applicator as claimed in claim 10, wherein the lip has a curved cross-sectional shape.

13. A wax applicator as claimed in claim 10, wherein said mounting part has a threaded bore, a plane of the outlet being substantially parallel to a longitudinal axis of said threaded bore of the mounting part, a correspondingly threaded part of the nozzle of the container engaging said threaded bore.

14. A wax applicator as claimed in claim 10, wherein the body portion includes an outer surface which inclines upwardly away from the spreader.

15. A wax applicator as claimed in claim 14, wherein said body portion includes a flat intermediate surface located between the lip and said outer surface.

16. A wax applicator as claimed in claim 10, wherein said body portion includes a handle projecting in a direction opposite to that in which the lip extends beyond the outlet.

17. A combination of a wax container, a wax applicator and wax heater, said wax applicator comprising, a body portion;

a mounting part integral to said body portion for mounting said body portion onto said wax container so that said wax container extends in a first direction;

a passage through said body portion that extends from said mounting part to an elongate outlet for wax that opens toward a second direction at an angle to said first direction;

an elongate closure plate for selectively closing said outlet;

a spreader integral to said body portion and extending along a width of said body portion parallel to an edge of said closure plate, said closure plate being slideably engaged to said body portion at a non-zero angle with a surface of said spreader, said edge of said closure plate and said surface of said spreader defining a periphery of said outlet, said spreader having a lip that extends in a third direction beyond the periphery of said outlet and at a second angle to said first direction, said second angle being greater than perpendicular; and said wax heater comprising a heater unit having a first heating chamber into which said container can be removably inserted and heated.

18. The combination as claimed in claim 17, wherein the heater unit includes a second heating chamber for heating another container.

19. The combination as claimed in claim 18, wherein the second heating chamber has an upright orientation for maintaining a container such that the nozzle end of the container is disposed higher than a bottom of the container.

20. The combination as claimed in claim 18, further comprising drainage means connected to said second heating chamber for draining any spillage of wax from a container located in the second heating chamber.

21. The combination as claimed in claim 18, wherein said first heating chamber has an angled orientation for maintaining the container at an angle, such that the nozzle end of the container is disposed lower than a bottom of the container.

22. The combination as claimed in claim 21, wherein said heating unit includes engagement means adjacent an open end of the first heating chamber to engage with and to hold a part of the wax applicator to maintain the container in the first heating chamber.

23. The combination as claimed in claim 17, wherein the heater unit includes at least one open-topped receptacle.

* * * * *